United States Patent [19]

Belden

[11] Patent Number: 4,824,093

[45] Date of Patent: Apr. 25, 1989

[54] HANDLING SIGNATURES

[75] Inventor: William P. Belden, Redlands, Calif.

[73] Assignee: Baldwin Technology Corporation, San Bernardino, Calif.

[21] Appl. No.: 190,873

[22] Filed: May 6, 1988

[51] Int. Cl.[4] ..... B65H 29/66

[52] U.S. Cl. ..... 271/216; 271/150

[58] Field of Search ..... 271/150, 151, 216; 198/425, 462; 53/529, 542

[56] References Cited

U.S. PATENT DOCUMENTS

| | | | |
|---|---|---|---|
| 4,330,116 | 5/1982 | Newsome . | |
| 4,381,108 | 4/1983 | Newsome . | |
| 4,531,343 | 7/1985 | Wood . | |
| 4,611,705 | 9/1986 | Fluck | 53/542 X |
| 4,625,499 | 12/1986 | Yamaguchi | 198/425 X |
| 4,641,489 | 2/1987 | Wood . | |

*Primary Examiner*—Richard A. Schacher

*Attorney, Agent, or Firm*—Christie, Parker & Hale

[57] ABSTRACT

A machine for arranging signatures in bundles includes a receiving conveyor onto which signatures are placed. The receiving conveyor moves the signatures in a shingled condition between deflecting surfaces to cause the signatures to assume an edge-standing condition. The edge-standing signatures move onto a consolidating conveyor so they move closer together. The signatures pass from the discharge end of the consildating conveyor onto an accumulating conveyor, which normally advances the signatures at a slightly slower speed than the consolidating conveyor. When enough signatures to make a bundle have passed onto the accumulating conveyor, the velocity along that conveyor is increasd substantially, and the consolidating conveyor is stopped to produce an isolated group of edge-standing signatues on the accumulating conveyor. A sword is extended into the signatures at the juncture of the consolidating and accumulating conveyors and pushes the signatures on the accumulating conveyor forward to form a distinct gap in the signatures to the rear of the sword. Compression fingers extend into the path behind the isolated signatures on the accumulating conveyor and push them forward. The sword moves rearwardly to engage the leading signature behind the gap and prevent the signatures from falling. The compression fingers push the isolated bundle through a board drop assembly, where boards are placed at each end of the bundle. Thereafter, the compression fingers compress the bundle so that a band may be secured around it.

5 Claims, 6 Drawing Sheets

HANDLING SIGNATURES

BACKGROUND OF THE INVENTION

This invention relates to handling flexible sheets, or signatures, and, more particularly, to arranging such sheets or signatures in bundles.

U.S. Pat. No. 4,531,343 to J. R. Wood (1985) and U.S. Pat. No. 4,641,489 to J. R. Wood (1987) disclose machines for causing signatures delivered from a printing press to rise out of a shingled condition and assume an edge-standing orientation as the signatures are conveyed along a path that leads away from the press. While the signatures are in the edge-standing condition, the machine consolidates them and separates them into bundles.

SUMMARY OF THE INVENTION

The present invention provides improved methods and apparatus for moving and compressing the bundles as they are formed, and for supporting the leading or forward end of advancing signatures which are to become the next bundle.

In terms of apparatus, the invention provides a machine for handling a succession of flexible sheets, such as signatures, to form a series of bundles of the signatures from the succession. The machine includes first and second conveyors aligned to define a path along which the signatures advance. Each conveyor is configured to support the signatures in an edge-standing condition. Each of the conveyors has moving surfaces against which the signatures are positioned so the signatures move with the moving surfaces. The moving surfaces of the second conveyor are disposed along the sides of that conveyor. The second conveyor is located immediately after the first so the signatures pass from the moving surface of a first conveyor to the moving surfaces of the second conveyor.

Drive means are provided for advancing the moving surfaces of the first and second conveyors at a normal operating velocity. Means are also provided for momentarily increasing the speed of the moving surfaces of the second conveyor to a velocity greater than the velocity of the moving surfaces of the first conveyor to produce a region of looseness in the succession of signatures. An extendible and retractable sword is located in a home position adjacent the path where the region of looseness develops. The sword is normally retracted at the home position to be clear of the path. Means are provided for extending the sword into the path so that it passes up between two adjacent signatures in the region of looseness. Means are provided for thereafter moving the sword forward to create a distinct gap in the succession of signatures so as to isolate a first bundle of signatures ahead of the gap.

Extendible and retractable compression fingers are disposed at a home position adjacent the path in the vicinity of where the looseness develops, and means are provided for extending the compression fingers into the gap behind the isolated bundle of signatures. Means are provided for moving the extended fingers along the path and away from the first conveyor so as to move the isolated first bundle of signatures off the second conveyor.

Means are provided for causing the extended sword to contact and support the forward end of the succession of signatures to the rear of the gap. Means are provided for moving the sword and the succeeding signatures supported by it to a support in the path and thus start the formation of a second bundle of signatures. Means are provided for retracting the sword from the path so the forward end of the signatures forming the second bundle bear against the support. Means are also provided for returning the sword to its home position.

The preferred form of the invention includes a sensor for detecting when the sword engages the forward end of the signatures forming a bundle. The sensor generates a signal to move the sword in front of the signatures in the second bundle and at a speed approximately equal to that of the advancing signatures. Preferably, the sword is mounted to pivot about a substantially horizontal axis transverse to the direction the signatures travel along the path. The sword pivots when contacted by the signatures, and actuates a switch, which sends a signal to cause the sword to move forward at approximately the speed of the advancing signatures.

In the preferred form of the invention, the sword is mounted on a reversible belt so that the sword can be moved rapidly in either direction along the path.

In the preferred form of the invention, the compression fingers are mounted on a carriage driven back and forth along the path by a ball screw conveyor.

These and other aspects of the invention will be more apparent from the following detailed description and the accompanying drawings.

FIGS. *7a–7i* are a series of schematic views showing the sequence of operation of the machine of this invention as it separates edge-standing signatures into bundles and thereafter compacts such bundles.

DETAILED DESCRIPTION

Figure 1:
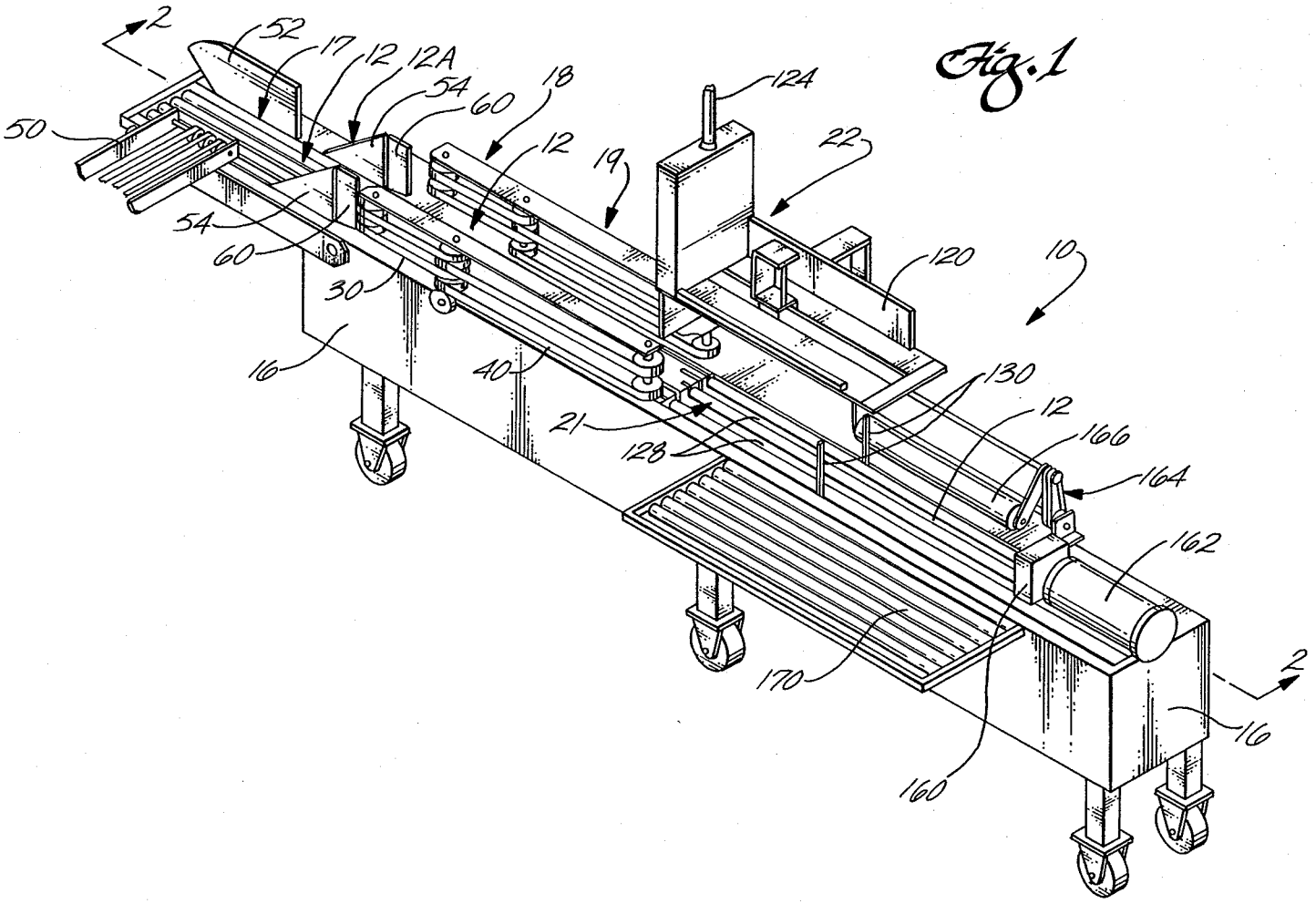
FIG. 1 is a perspective view of a machine for handling signatures in accordance with the present invention.

Referring to FIGS. 1 and *7a–7i*, a machine 10 receives signatures 11 delivered to it in a shingled condition from a high-speed printing press (not shown). The machine advances the signatures along a substantially horizontal path 12 (FIG. 1), initially in a shingled condition. As the signatures advance, they encounter a gate 12A on path 12. The gate forces the signatures to rise to an edge-standing condition, with the major planes of the signatures substantially perpendicular to the direction of travel along the path. As the signatures advance along the path, they are consolidated, i.e., caused to move more closely together. After enough edge-standing signatures have been accumulated, the machine separates some of the signatures from the remainder to form an isolated, loose bundle 13 (FIG. *7c*), which advances separately, having end boards 14 placed against its ends. The loose bundle is thereafter compressed and tied with a strap 15 (FIG. 7*h*) from a strapper (not shown), which may be of conventional type.

The machine includes a frame 16 which supports a receiving conveyor 17, a consolidating conveyor 18, and an accumulating conveyor 19, all in that order to form the path 12 along which the signatures advance. At the downstream end of the receiving conveyor 17, the frame supports the gate 12A which causes the signatures, as they advance along the path 12, to rise from a substantially horizontal shingled orientation to the edge-standing orientation.

Figure 2:
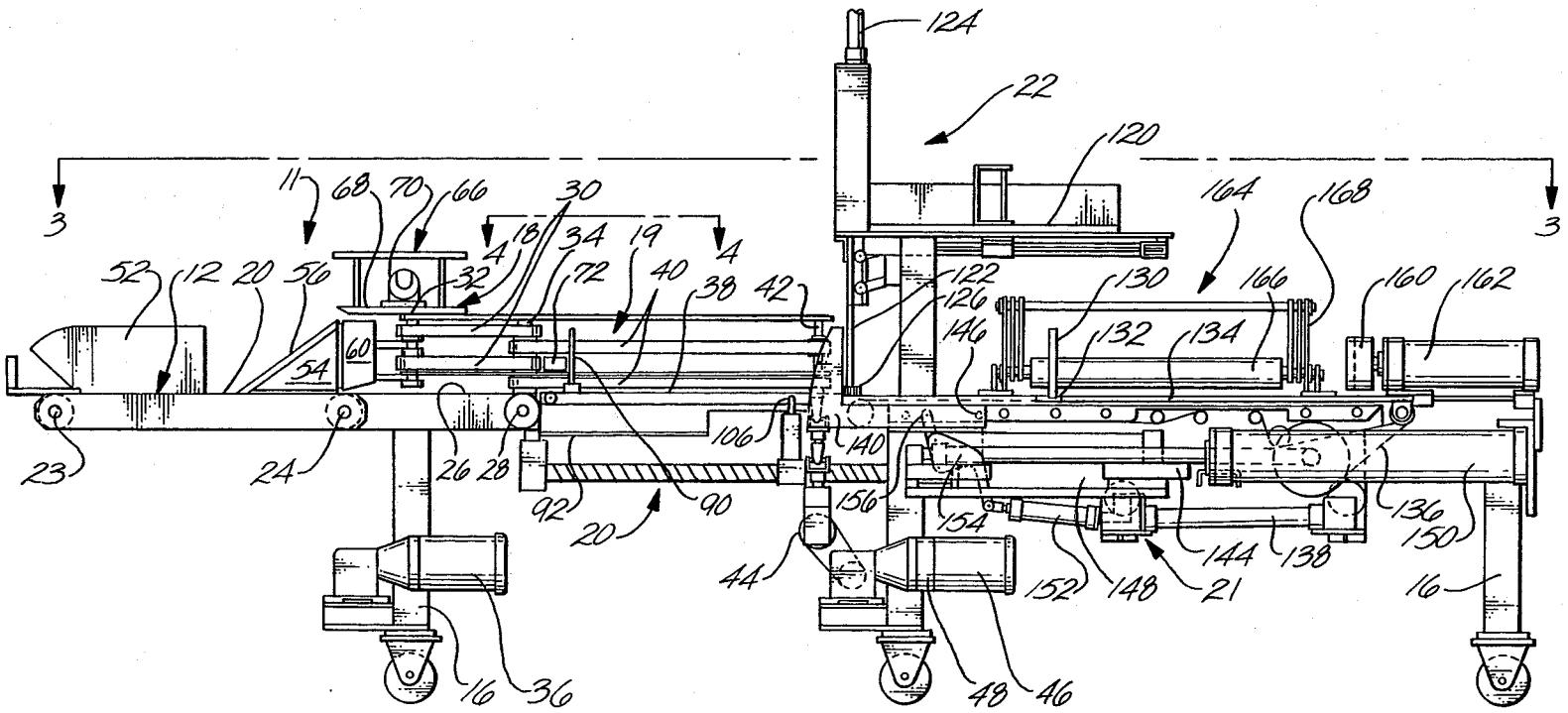
FIG. 2 is a sectional view taken along line 2—2 of FIG. 1 showing the sword and compression fingers.

A separating assembly 20 (FIG. 2), described in more detail below, is mounted on the frame in the vicinity of the accumulating conveyor 19. As described in more detail below, the separating assembly causes some of the signatures accumulated in the edge-standing condition along the accumulating conveyor to separate from the following signatures to produce the loose bundle 13 shown in FIGS. 7*c* and 7*d*. The separating assembly advances that loose bundle at a greater velocity to a compression unit 21, which is mounted on the frame adjacent the path of the signatures. As explained in more detail below, the separated signatures of the loose bundle are compressed and tied to form a compact bundle. The frame also supports an end board drop assembly 22 for placing one end board 14 ahead of the signatures as they accumulate on the accumulating conveyor 19 and another end board at the trailing end of the signatures in the separated bundle, so the bundle has a rigid end board at each end.

The receiving conveyor 17 includes four parallel endless belts 23 (FIG. 3) arranged side-by-side with their respective upper passes disposed to carry the shingled signatures. Preferably, the outer surfaces of the belts 23 have transverse ribs (not shown) to grip the trailing edges of the signatures and move the signatures toward the consolidating conveyor 18. The belts 23 pass over pulleys (not shown) mounted on horizontal shafts 23A and 24 in bearings (not shown) supported by the frame. The shaft 24 at the discharge end is powered.

The consolidating conveyor 18 has three parallel endless consolidating belts 26 located side-by-side and passing around pulleys (not shown) at the ends of the consolidating conveyor 18. The pulleys at the discharge end of the consolidating conveyor are mounted on a powered shaft 28. The pulleys for belt 26 at the inlet end are mounted on the power shaft 24 so that each upper pass of the consolidating belts 26 is between adjacent belts 23, and thus form a smooth extension of the upper passes of the receiving belts 23.

The pulleys for the consolidating belts are freewheeling on the power shaft 24. Power shaft 28 turns somewhat slower than power shaft 24 so that the belts 26 of the consolidating conveyor move slower than the belts 23 of the receiving (gate) conveyor. This causes the signatures to pack more closely together, or to consolidate, after leaving the receiving conveyor 17. The transition to the lower speed of the consolidating conveyor belts 26 is gradual. Therefore, the belts 26 must be free to slip slightly with respect to the lower edges of the signatures, at least in the upstream region of the consolidating conveyor 18. Therefore, the outer surfaces of the consolidating belts are relatively smooth.

In addition to the lower consolidating belts 26, the consolidating conveyor 18 also includes two vertically spaced endless side consolidating belts 30 (FIGS. 1–4) on each side of the signature path to form the sides of the consolidating conveyor. The endless consolidating side belts 30 pass around pulleys 31 on vertical shafts 32 and 34, each of the latter being coupled to the power shaft 28 for the lower consolidating belts 26. Thus, the inner passes of the side belts 30 in the upper passes of the lower belts 26 in the consolidating conveyor 18 move at the same speed. The vertical power shafts 34 and the horizontal power shaft 28 are at the same location along the path 12. The vertical shafts 32 are spaced somewhat downstream from the common shaft 24 of the receiving and consolidating conveyors 17 and 18. As a consequence, the side belts 30 are shorter than the lower belts 26. Thus, when the signatures move onto the consolidating conveyor 18, they are initially advanced only by the lower consolidating belts 26, but thereafter they come in contact with the side belts 30, which engage the side margins of the signatures and assist the lower belts 26 in advancing the signatures.

Both the receiving and the consolidating conveyors 17 and 18 are powered by a gear motor 36 (FIG. 2) carried by the frame 16 and coupled to the horizontal shafts 24 and 28 and the vertical shafts 34. The coupling to the shafts 28 and 34 for the consolidating conveyor is through a clutch-brake 37 (FIG. 3), which can be used to disengage the motor 36 from the shafts 28 and 34 to stop the belts 26 and 30 of the consolidating conveyor 18.

Figures 7A, 7B, 7C, 7D, 7E:
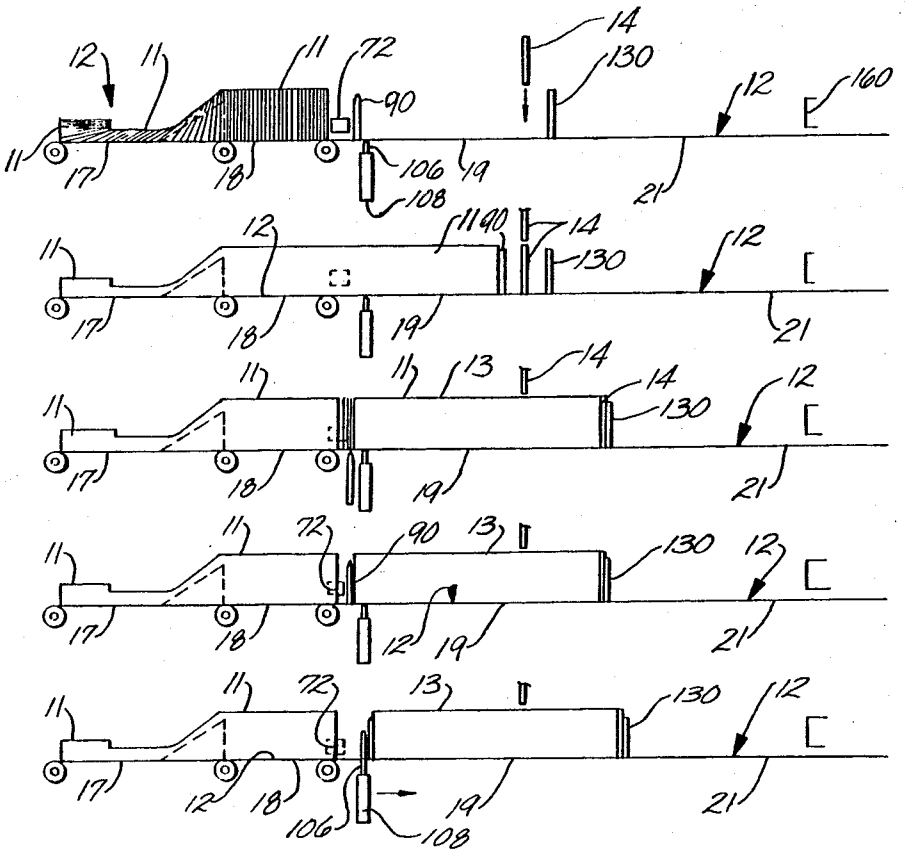

The accumulating conveyor 19 includes a horizontal, flat skid plate 38 (FIGS. 2, 3, and 4) which forms an extension of the path 12 from the lower belts 26 of the consolidating conveyor. The accumulating conveyor 19 also has a pair of vertically spaced, endless side belts 40 along each side of the path 12 and adjacent the skid plate 38. The side belts 40 pass around pulleys carried by vertical shafts 34 for the consolidating conveyor, and by pulleys rigidly mounted on powered vertical shafts 42 at the downstream end of the accumulating conveyor 19. The pulleys for side belts 40 on the shaft 34 rotate freely with respect to that shaft, but the pulleys on the power shaft 42 are driven by that shaft, and that motion is such that the belts 40 normally move at a speed slightly less than that of the belts 26 and 30 for the consolidating conveyor 18. The inner passes of the side belts 40 move away from the consolidating conveyor 18. The speed of the side belts 40 can be increased significantly on command, and this creates within the series of edge-standing signatures a loose region at the transition between the consolidating conveyor 18 and the accumulating conveyor 19 (see FIG. 7*c*). To this end, the drive shafts 42 are also coupled to the gear motor 36 which normally drives the belts 40 slower than the belts 26 and 30 for the consolidating conveyor, but the connection is through an overrun clutch 44 which allows the shafts 42 to turn at a greater speed than that imparted to them by gear motor 36. The greater speed is derived from a second gear motor 46 (FIG. 2) carried by the frame and coupled to the shafts 42 through a clutch 48 and the overrun clutch 44. The clutch-brake 37 and the clutch 48 operate in conjunction with each other. When the clutch 48 is energized, the motor 46 turns the shafts 42 at a higher velocity than that which would be imparted to them by the motor 36. As a consequence, the signatures on the accumulating conveyor 19 move away from the signatures on the consolidating conveyor 18, creating the loose region in the signatures (FIGS. 4 and 7*c*). At the same time, the clutch-brake 37 stops the belts 26 and 30 of the consolidating conveyor 18.

The gate at the discharge end of the receiving conveyor 17 causes signatures, as they pass through the gate, to rise from the shingle orientation to an upright or edge-standing orientation, as shown in FIG. 7*a*. The signatures are delivered from the printing press (not shown) on a feed conveyor 50 (FIGS. 1 and 3) positioned at a right angle to the receiving conveyor 17. The discharge end of the feed conveyor 50 is slightly higher than the adjacent inlet end of the receiving conveyor 17. The feed conveyor 50 discharges the signatures onto the receiving conveyor and against an upright bump plate 52 on the opposite side of the receiving conveyor. On striking the bump plate, each sheet drops down and accumulates in a pile at the inlet end of the receiving conveyor (FIG. 7*a*). The pile of signatures rests on the upper passes of the horizontal belts 23 for the receiving conveyor, and as the belts move they withdraw signatures one after the other from the bottom of the pile. However, before the belts 23 completely withdraw the lowermost sheet from the bottom of the pile, the belts come in contact with the sheet immediately above the lowermost sheet, and enough friction develops between the second lowermost sheet and the belts to cause it to withdraw as well. As a consequence, the signatures leave the stack in a tightly shingled condition and advance toward the orienting gates in that condition.

Figure 3:
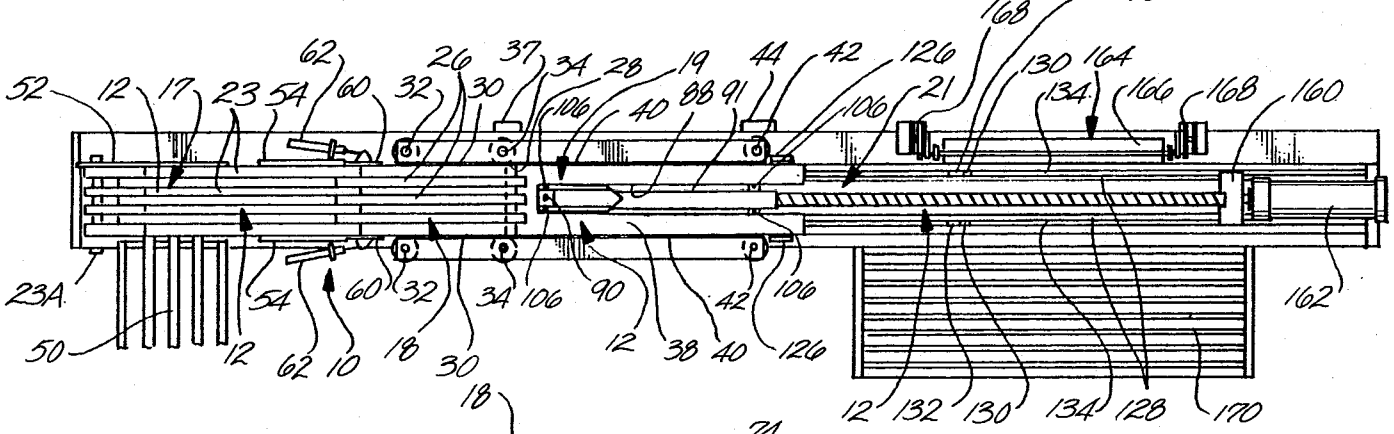
FIG. 3 is a sectional view taken along line 3—3 of FIG. 2.
Figure 4:
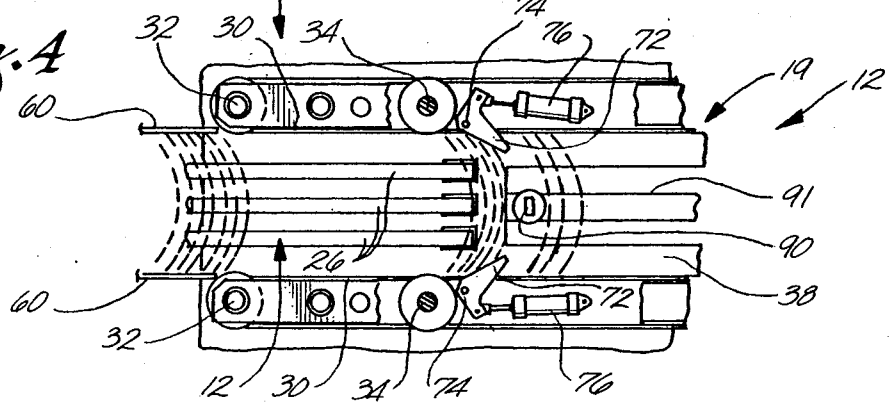
FIG. 4 is an enlarged sectional view of the machine taken along line 4—4 of FIG. 2 showing restraining wings for momentarily holding the signatures as the gap is developed in the region of looseness.

The gate is, in effect, two deflecting plates 54, one on each side of the receiving conveyor 17 (FIG. 3). The deflecting plates are spaced apart at a distance less than the width of the signatures. At their upstream ends, the plates 54 have sloping surfaces 56 (FIG. 2) which face generally upwardly and inwardly, and are inclined upwardly in the direction of the advance of the signatures. As the signatures move up against the plates 54, their side edges ride up onto the sloping surfaces 56, causing the signatures to bow forwardly. The distortion tends to propagate upstream so the signatures ahead of the gates also bow slightly, but the bow diminishes and does not exist at the pile where the signatures first accumulate on the receiving conveyor 17. As the signatures bow forwardly at the sloping surfaces 56 on the deflecting plates, they are driven further into the gate by the underlying belts 23 of the receiving conveyor, the ribs of which engage the trailing edges of the signatures. As a consequence, the signatures move into the space between the two plates 54, their side edges wiping against the converging surfaces of the plates 54. Thus, the forward bow remains in the signatures at the plates 54 and increases as the signatures move forward. The bowing, coupled with the application of the propelling force at the trailing edges of the signatures, causes the leading edges of the signatures to rise gradually. By the time a sheet reaches the downstream end of the converging space between the two deflecting plates 54, the sheet is standing on edge, but because of the shingled array, the edge-standing signatures are not yet consolidated. Instead, they are spaced at approximately the former shingle width. Thus, as the signatures emerge from the orienting unit in an edge-standing or upright condition, they are still loosely consolidated and pass onto the consolidating conveyor 18 in that condition.

The deflecting plates 54 extend downstream to about the axis of the drive shaft 24, which is common to the receiving and consolidating conveyors 17 and 18. The downstream edges of the plates 54 have vertical margins to which holding plates 60 are attached by piano-type hinges (not shown). Air cylinders 62 urge the holding plates inwardly into the path of the signatures as a newly-started array of signatures approaches the orienting unit. Thus, the leading signatures of an array will not topple forward on the merging from the space between deflecting plates 54 of the orienting unit. Instead, the edges of the signatures engage the holding plates 60, which at this point lie in the path of the signatures. The leading signatures tend to consolidate against the holding plates, but when enough signatures emerge from the orienting unit, they push the holding plates 60 outwardly against the bias of the air cylinders 62.

Eventually, the holding plates 60 are forced outwardly against stops (not shown), which align them with the inner passes of the side belts 30 for the consolidating conveyor 18. The side edges of the edge-standing signatures slide along the plates 60 as the signatures pass from the constriction formed by the deflecting plates 54 to the side belts 30 of the consolidating conveyor 18. Thus, during normal operation of the machine, the holding plates maintain the signatures in a bowed condition (i.e., bowed convex forward) within the upstream region of the consolidating conveyor, as shown in FIG. 4. This keeps the signatures upright on the lower belts 26 for that conveyor.

The inner passes of the side belts 30 for the consolidating conveyor are spaced apart a distance slightly less than the width of the signatures, and that distance generally equals the distance between the holding plates 60 when the plates are spread outwardly and aligned with the side belts 30. Thus, the signatures remain bowed forwardly between the side belts 30 for the full length of the consolidating conveyor 18.

The consolidating conveyor 18 supports an aligning unit 66 (FIG. 2) which includes a horizontal plate 68 extending from the space between the two deflecting plates 54 of the orienting unit to the space between the side belts 30 of the consolidating conveyor. When unrestrained, the horizontal plate 68 is loosely suspended at an elevation slightly higher than the holding plates 60, yet is not so high as to avoid contact with the signatures. A vibrator 70, secured to the upper surface of the horizontal plate 68, causes that plate to vibrate. As the signatures move through the downstream region of the orienting unit, where the gate is formed by the deflecting plates 54, and pass into the initial region of the consolidating conveyor, the signatures pass beneath the vibrating horizonal plate 68 which rides on the upper edges of the signatures. The vibrating plate bounces against the upper edges of the signatures and forces the highest signatures down, so that the upper edges are forced into a substantially horizontal common plane before the signatures are more tightly compacted downstream.

Restraining wings 72 (FIG. 4) at the downstream end of the consolidating conveyor 18 move between retracted and extended positions. When extended, the wings 72 lie in the path of the signatures at the location where they transfer from the consolidating conveyor 18 to the accumulating conveyor 19. When retracted, the wings 72 lie between the side belts 40 at each side of the accumulating conveyor and do not interfere with the movement of the signatures along that conveyor. The wings 72 pivot about respective vertical pins 74 on the accumulating conveyor 19 and are each connected to respective air cylinders 76, which cause the wings to move between the extended and retracted positions. The wings 72 have relatively flat vertical surfaces which face the signatures when the wings are extended to lie at an angle of between about 30° and about 45° with respect to the direction of advance.

The signatures moving along the path are bowed forward so that the midportion of each signature leads its side edges (FIG. 4). Thus, the midportions pass onto the accumulating conveyor 19 first, but in doing so, they encounter only the skid plate 38, which exerts no propulsive force. The trailing side edges of the signatures are in contact with the side belts 30 of the consolidating conveyor, and those belts continue to drive the signatures forward. With the wings 72 retracted, the side edges of the signatures merely pass to the side belts 40 of the accumulating conveyor 19, where they move forward at a somewhat slower speed and, therefore, move more closely together. Thus, a continuous array of signatures normally exists along the consolidating and accumulating conveyors. However, when the wings 72 are extended, the side edges of the advancing signatures at the end of the consolidating conveyor 18 do not contact the side belts of the accumulating conveyor 19 but, instead, are intercepted by the wings 72, the leading signatures being urged against the wings 72 by the continued advancement of the signatures.

The wings 72 remain extended for only a short duration, and then only when the speed of the accumulating conveyor 19 is increased to advance a loose bundle 13 to the compressing unit 21 (FIGS. 7*d* and 7*e*). The two side edges of any signature usually are not precisely at the same point of advancement along the path, and by extending into the path at the time of separation of the signatures (described below), the wings 72 prevent the signatures at the transition between the consolidating conveyor and the accumulating conveyor from being propelled by side belts 30 and 40 operating at two different speeds. Thus, the wings 72 prevent one side edge of a signature from being driven forward by a fast-moving belt 40 of the accumulating conveyor 19, while the other side edge of that signature remains with a slower-moving belt 30 of the consolidating conveyor 18.

The separating assembly 20 causes a separation in the array of signatures that pass through the accumulating conveyor 19 and onto the compression unit 21 so as to isolate a portion of the signatures in the form of a loosely-compacted bundle 13 (FIGS. 7*c*–7*g*). The separating assembly, for the most part, lies beneath the accumulating conveyor 19 and includes the gear motor 46 and its clutch 48. When energized, the motor 46 and clutch 48 cause the side belts 40 of the accumulating conveyor 19 to speed up for a short period to create looseness in the succession of signatures at the transition between the consolidating conveyor and the accumulating conveyor (FIG. 7*c*). The duration of the fast movement of side belts 40 lasts long enough to advance the separated signatures a short distance, say, one or two inches. The wings 72 remain retracted during this initial separation.

An elongated, longitudinally extending slot 88 in the horizontal skid plate 38 opens out of the rear of the skid plate. A vertical sword 90 is mounted on an endless, reversible belt 91, which travels longitudinally under the slot 88. The sword (shown in more detail in FIGS. 5 and 6) is extendible to an upward position into the path of the signatures and is retractable to a lower position out of the path of the signatures. The sword 90 is extended or elevated after the initial separation has created a region of looseness in the array of signatures, so that the sword will not dislodge any signatures from the path or tear them. The sword elevates at the upstream end of the slot (the home position of the sword) and then moves forwardly, being carried by the endless belt 91. At the same time, the side belts 40 of the accumulating conveyor 19 are energized through the clutch 48. The sword and side belts 40 drive the signatures on the accumulating conveyor forward a short distance, and the endless sword belt 91 stops. This creates a distinct gap in the succession of signatures, with all signatures downstream from the gap constituting the loose bundle 13 (FIG. 7*c*). As the sword moves forward, the wings 72 extend into the path to restrain the signatures to the rear of the gap.

To provide the vertical and horizontal motions for the sword 90, it is mounted to slide in a vertical piston mounted by a horizontal transverse pivot pin 93 to a bracket 94 secured to the endless belt 91, which is driven in the forward and reverse directions by a sword motor 95 connected to one of two pulleys 96 secured to the machine frame and about which the endless belt 91 travels. A tension spring 97, secured at one end to the belt 91 and at its other end to the lower end of the piston 92, urges the piston to pivot in a counterclockwise direction (as viewed in FIG. 5), causing a proximity switch 98 mounted on the sword belt to be in a normally open position. The proximity switch closes when the sword is engaged by advancing signatures to the rear of the gap, causing the sword piston 92 to pivot in a clockwise direction (as viewed in FIG. 5). This causes the sword motor 95 to advance the sword at a rate approximately equal to that of the signatures behind the sword so the sword supports those signatures and keeps them from falling forward. This operation is described in more detail below.

A pair of vertical and laterally spaced compression fingers 106 are each mounted in a respective finger piston 107 secured to a carriage 108 mounted to travel longitudinally back and forth along a threaded horizontal ball-screw shaft 109 journaled at its opposite ends in bearings 110 mounted on the machine frame. When the compression fingers are extended, they project up above the level of the skid plate 38 and into the signature path so that they, like the sword 90, may be inserted behind the segregated loose bundle 13 of signatures. when retracted, the upper ends of the push rods lie below the skid plate 38. A reversible compression motor 111, mounted on the machine frame, supplies power through a gear box 112 to one end of the threaded shaft 109. Thus, as the compression motor 111 turns, the carriage and compression fingers mounted on it move back and forth along the threaded shaft 109. The fingers 106 can be extended or retracted by operation of the piston 107 in which they are mounted. Instead of a piston for each compression finger, a single piston (not shown) can be used to drive a mechanical linkage (not shown) connected to each of the fingers to cause them to extend or retract as the single piston is operated. The threaded shaft 109 extends for the length of the accumulating conveyor and the compression unit 21.

Figure 5:
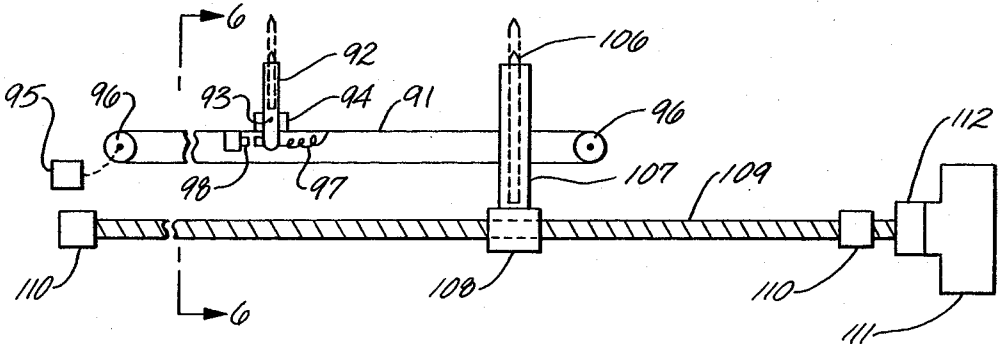
FIG. 5 is a detail view of the mechanisms for mounting and moving the sword and the compression fingers.
Figure 6:
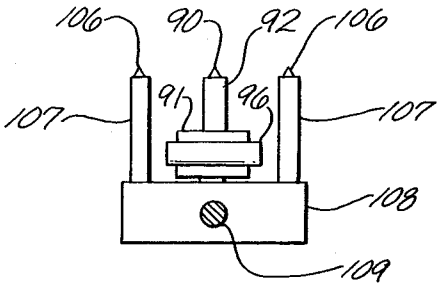
FIG. 6 is a view taken on line 6—6 of FIG. 5.

The compression fingers are in a home position on the threaded shaft 109 at the location of the gap as it is formed by the sword and are inserted into the gap almost immediately after the gap is formed. Compression motor 111 is operated to turn the shaft to cause the carriage 108 and compression fingers 106 to move forward and push the loose bundle from the accumulating conveyor, as described in more detail below. As the compression fingers engage the rear end of the loose bundle, the sword motor 95 operates to drive the extended sword in a reverse direction until it contacts the forwardmost signatures behind the gap. This causes the sword and the sword piston to pivot in a clockwise direction (as shown in FIG. 5), causing proximity switch 98 to close. This reverses the direction of the sword motor 95 so that the sword belt 91 carries the sword forward at a rate approximately equal to that of the advancing signatures behind the gap so that those signatures remain in an upright position.

Figures 7F, 7G, 7H, 7I:
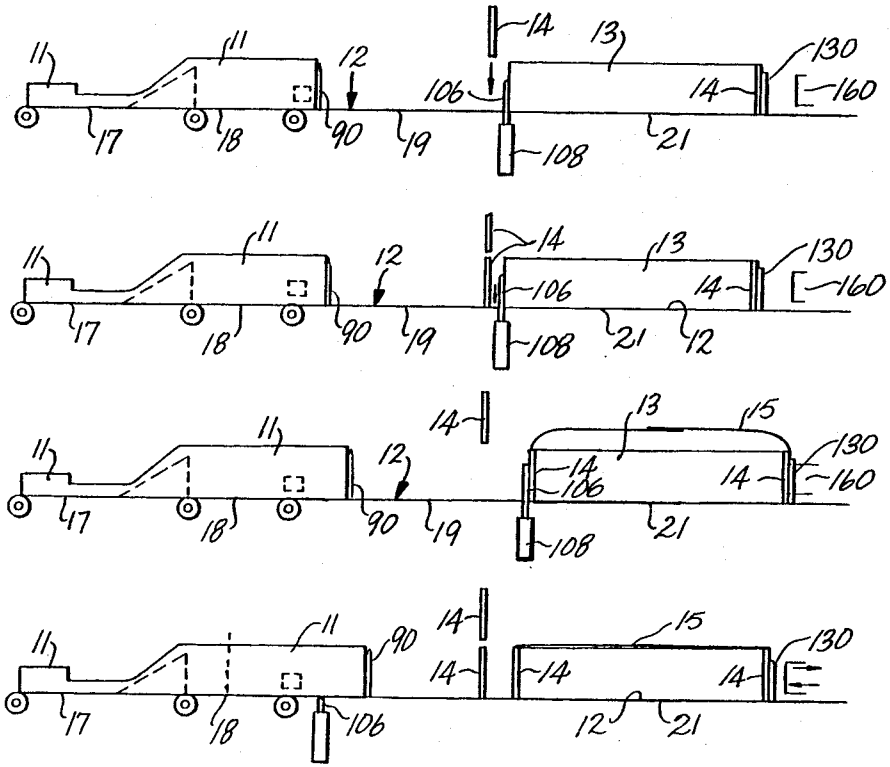

Initially, the sword 90 and compression fingers 106 are in their respective "home" positions at the upstream end of the slot 88 in the skid plate 38, and the sword and compression fingers are retracted so that their respective upper ends are under the skid plate. After the sword 90 and side belts 40 move the signatures in the accumulating conveyor 19 a short distance forward to create the distinct gap and separate the loose bundle 13, the compression finger cylinders 107 are energized to extend the compression fingers 106 upwardly above the skid plate 38 and into the path behind the loose bundle. At this time, the belts 26 and 30 of the consolidating conveyor 18 start moving to prevent the upright signatures from backing up in the gate formed by the deflecting plates 54 of the orienting unit, but the wings 72 remain extended to prevent the signatures at the downstream end of the consolidating conveyor from passing into engagement with the fast-moving side belts 40 of the accumulating conveyor 19. At this time, the sword motor 95 is energized to move the sword to the rear until it contacts the forward signatures behind the gap. At the same time, compression motor 111 is energized to drive the push fingers against the rear end of the loose bundle 13, while the side belts 40 are driven by the gear motor to move them at the increased speed. The compression fingers and side belts 40 cooperate to move the loose bundle rapidly all the way to the end of the accumulating conveyor 18, beyond which the compression fingers 106 continue to move the bundle and, in so doing, push it fully onto the compression unit 21 (FIG. 7*f*). The wings 72 remain extended to hold the signatures at the discharge end of the consolidating conveyor 18 from contacting the fast-moving side belts 40 of the accumulating conveyor 19. Once the side belts 40 and the compression fingers 106 have delivered the bundle to the compression unit 21, the clutch 48 for the gear motor 46 is deenergized, and the side belts 40 for the accumulating conveyor 19 again derive their power from the other gear motor 36, which, operating through the overrun clutch 44, moves the side belts 40 at the slower, normal speed, which is slightly less than the belts 26 and 30 of the consolidating conveyor 18. Simultaneously, the wings 72 retract and allow the signatures at the discharge end of the consolidating conveyor 18 to move into engagement with the now slow-moving side belts 40 of the accumulating conveyor 19.

The board drop assembly 22 (FIGS. 1 and 2) is designed to place an end board 14 in an upright position at the discharge end of the accumulating conveyor 19, so that the leading signatures in an array of the loose bundle comes against that board as the signatures advance beyond the accumulating conveyor. Just before reaching that end board, the sword is retracted so that the forward end of the loose bundle of signatures engages the board, which is released from the board drop assembly 22 and pushed forward along against a pair of upright follower bars 130, which move forward at a speed which keeps the board from falling away from the signatures. The board drop assembly is also designed to deposit an end board behind the trailing end of the signatures in a loose bundle that has been separated on the accumulating conveyor 19. A board drop assembly and its operation is described in detail in U.S. Pat. No. 4,641,489 and, therefore, is not described in detail here. Any suitable board drop system can be used in conjunction with the present invention.

The path 12 for the signatures continues onto the compression unit 21, which includes longitudinally extending, parallel skid bars 128 (FIG. 3) mounted on the machine frame and onto which the side belts, operating at the increased speed, and the compression fingers 106 drive the loose bundle 13. The skid bars 128 are long rollers which revolve about axes parallel to the signature path.

The follower bars 130 (FIG. 2) project upwardly from a slide 132 into the signature path. The slide 132 moves along a slideway 134 on the machine frame and is connected by a chain-and-sprocket coupling 136 to a cable cylinder 138 below the slideway 134. The cable cylinder 138 acts through the chain-and-sprocket coupling 136 to urge the follower bars 130 toward the accumulating conveyor 19. With no signatures on the compression unit 21, the follower bars 130 are located only slightly downstream from the board drop assembly. Thus, as signatures accumulate on the accumulating conveyor, they eventually fill that conveyor and move against an end board previously placed in front of them by the board drop assembly. The signatures thereafter dislodge that end board and move it against the follower bars 130, which yield and yet continue to direct enough force against the end board to keep it and the signatures at the leading end of the bundle upright and compacted (FIG. 7*c*). The force exerted by the bars 130 is derived from the cable cylinder 138. This force not only creates a compaction of the signatures behind it in the compression unit, but further causes a progressive compaction along the accumulating conveyor, with the signatures at the downstream end of the accumulating conveyor being more tightly compacted than the signatures at the upstream end.

The loose bundle 13 is compressed between the compression fingers at the rear end and a stop 160 (FIGS. 2 and 3) at the forward end. The stop 160 is the end of the signature path 12. The stop 160 is the end of the signature path 12. The stop 160 is mounted on an air cylinder 162 which, in turn, is secured to the machine frame. The stop 160 is bifurcated so that the banding strap 15 (FIGS. 7*g* and 7*h*) may be passed through it. When the bundle is compressed, the compression fingers bear against the end board at the trailing end of the bundle, while the end board at the leading end abuts against stop 160 (FIG. 7*h*). At that time, a banding strap, that is in place below the bundle and with its end projected through the slot in the bifurcated stop 160, is gathered over the bundle so that the strap extends the full length of the top and the bottom of the bundle, as well as across the outwardly presented faces of the end boards. The strap is thereafter secured around the bundle with a strapping machine, which may be of the conventional type.

Once the banding strap is secured in place, the compression fingers withdraw slightly and retract, and the cylinder 162 is energized to extend the stop 160 a short distance upstream (FIG. 7*i*). The cylinder 162 immediately retracts to withdraw the stop from contact with the leading end board and the strap which extends across that board. This enables the bundle to be moved out of the signature path without snagging the strap on the stop 160. The compression fingers then return to their home position to be ready for insertion into the next gap.

The machine includes a control unit for operating the motors, the clutch-brake 37, the clutch 48, and the cylinders in the sequence described above.

OPERATION

When the machine is first placed in operation, signatures move along the feed conveyor 50 in a low, shingled condition with their folds located along one side of the conveyor so that those folds extend parallel to the direction of advance. The feed conveyor discharges signatures one after the other onto the receiving conveyor 17 and against the bump plate 52, which they strike, dropping downwardly onto the receiving conveyor. The signatures accumulate in a slight pile at the upstream end of the receiving conveyor (FIG. 7*a*), where the signatures are jogged along the bump plate so as to bring the ends of the signatures adjacent the bump plate into registration. The height of the pile is monitored by a sensing device (not shown) which controls the speed of the gear motor 46. The belts 23 of the receiving conveyor 17 pass beneath the pile of signatures and withdraw signatures one at a time from the bottom of the pile. Each withdrawn signature slides beneath the signature above it, but before the lowermost signature is fully extracted, the belts 23 come against the immediately overlying signature and move it as well. Thus, the signatures leave from beneath the pile in a shingled condition, with the shingle being much tighter than the relatively loose shingled condition on the feed conveyor 50 (FIG. 7*a*). Not only does the direction of advance change at the transfer from the feed conveyor to the receiving conveyor, but the orientation of the signatures also changes, because, on the receiving conveyor, the signatures advance preferably with their folded edges trailing and presented downwardly.

The belts 23 of the receiving conveyor move the shingled signatures to the deflecting plates 54, where the side edges of the signatures ride up onto the sloping surfaces 56 of those plates and then move into the slightly converging gate between the plates. This causes the signatures to bow forwardly and rise at their leading edges (FIG. 7*a*). The signatures continue to rise as the belts 26 move them through the gate between the deflecting plates 54, so that, by the time they emerge from the gate, they are standing on edge, with the folded edge down and extending transverse to the direction of travel. Moreover, the bowing and rise tend to propagate with diminishing intensity upstream, with each signature affecting the inclination and contour of the signature preceding it.

The holding plates 60 at the downstream edges of the deflecting plates 54 keep the leading signatures from falling out of the gate between the deflecting plates 54. The leading signatures push the plates 60 open against the bias exerted by the air cylinder 62. Eventually, the holding plates 60 move to a fully-open position in which they are approximately parallel and aligned with the inside passes of the side belts 30 for the consolidating conveyor 18. So disposed, the plates 60 are spaced apart a distance slightly less than the width of the signatures. This maintains the signatures in an edge-standing and forwardly-bowed configuration.

On leaving the gate, and entering the space between the holding plates 60, the signatures move onto the lower belts 26 of the consolidating conveyor, which travels at a speed less than the belts 23 of the receiving conveyor. This causes the signatures to consolidate. In other words, the edge-standing signatures, having been formerly shingled, occupy more space than their actual folded thickness. At the consolidating conveyor, this space is reduced. In this same region, the vibrating horizontal plate 68, riding on the upper surfaces of the signatures, urges any high signatures down so that the upper edges of the signatures are generally in registration. The growing array of signatures continues into the space between the side belts 30 of the consolidating conveyor 18 (FIG. 7*a*) and then, without interruption, into the space between the side belts 40 of the accumulating conveyor 19. Since the side belts 40 of the accumulating conveyor 19 move slower than the belts 26 and 30 of the consolidating conveyor 18, the signatures further consolidate on the accumulating conveyor 19, so that the space between adjacent signatures is virtually eliminated. The spacing between the side belts 30 and the side belts 40 is less than the width of the signatures, so the signatures remain bowed throughout the length of the consolidating and accumulating conveyors (FIG. 4). The bow in the signatures, together with the action of the sword, keeps the leading signatures upright.

As the signatures pass the retracted wings 72, the forward face of the first signatures through the machine engages the extended sword 90 near its home position, and causes the sword piston to pivot forward and activate the sword proximity switch 98 so the sword will move forward with the signatures.

As the signatures move along the accumulating conveyor, they approach an end board 14 held in the board drop assembly 22 (FIG. 7*b*). As the leading signature approaches the end board, the sword is retracted and returns to the home position shown in FIG. 7*c*. The leading signature proceeds forward against the end board, and the following array of signatures push the end board forward onto the skid bars 128 of the compression unit 21. The upright follower bars 130 bear against the downstream side of the end board and keep it from falling forward. The follower bars, being coupled with the cable cylinder 138, maintain a light force on the end board and leading signatures, yet yield as the array of signatures move into the compression unit. This force further compresses the signatures together along the compression unit and induces a progressive compression along the accumulating conveyor 19.

When enough signatures have passed onto the accumulating conveyor to produce a bundle of the desired size, the control unit produces a signal which initiates the separation of the signatures on the accumulating conveyor from the following signatures on the consolidating conveyor. This forms the gap in the array of signatures at the transition between the consolidating and accumulating conveyors (FIG. 7*c*), and all signatures ahead of the gap are thereafter processed as a bundle 13. The signal for creating the gap may be based from a count taken automatically along the feed conveyor 50, or from sensing the position of the lead signature moving along the path 12.

The signal that starts the separation actuates the clutch-brake 37 that couples the belts 26 and 30 of the consolidating conveyor with the gear motor 36, and, as a result, those belts stop. At the same instant, the other clutch 48 engages to couple the gear motor 46 with side belts 40 of the accumulating conveyor 19. The clutch 48 is engaged for a short duration, namely, only long enough to move the signatures on the accumulating conveyor ahead only an inch or so. This loosens the signatures at the transition between the consolidating and accumulating conveyors.

The sword air cylinder 92 is energized to elevate the sword 90 into the loosely spaced signatures at the upstream end of the accumulating conveyor (FIG. 7*d*). Once the sword is extended or elevated, the sword motor is energized to drive the sword forward. At the same time, clutch 48 energizes the side belts 40 of the accumulating conveyor, causing those belts to move at their higher speed. The sword and belts move the signatures on the conveyor forward as a whole, and the sword pushes the signatures immediately ahead of it forward to create a distinct gap in the array of signatures (FIG. 7*e*). At the same time, the air cylinder 76 for the wings 72 are energized to move the wings 72 to their extended position to lie in the signature path and face the signatures at the discharge end of the consolidating conveyor 18 (FIG. 4). The extended wings 72 prevent the side edges of those signatures not gathered by the sword 90 from coming against the side belts 40 of the accumulating conveyor. The clutch-brake 37 for the consolidating conveyor deactivates when the wings 72 extend, and this again puts the belts 26 and 30 of the consolidating conveyor in motion so that the signatures do not back up in the gate between deflecting plates 54. During this same period, the cylinders 107 are actuated to extend compression fingers 106 upwardly into the gap cleared by the sword. This places the compression fingers 106 behind the bundle.

With the compression fingers extended, the clutch 48 for the accumulating conveyor 19 is reengaged, and the side belts 40 of the accumulating conveyor 19 move at their higher speed, while the compression fingers also move forward. The compression fingers 106 and the edge belts 40 move together and force the separated bundle out of the accumulating conveyor 19 and onto the roller-type skid bars 128 of the compression unit 21 (FIG. 7*f*). Once the trailing signature of the bundle clears the end of the accumulating conveyor 19, the compression fingers 106 continue to advance the bundle under the force exerted by them until the bundle is beyond the location at which the board drop assembly deposits an end board into the path 12.

As the bundle moves onto the skid bars 128 of the compression unit, the follower bars 130 yield, yet remain against the end board at the leading end of the bundle to prevent both the board and the leading signatures from falling forward. While the bundle advances, the wings 72 remain extended to prevent signatures at the discharge end of the consolidating conveyor from being caught by the side belts 40 of the accumulating conveyor 19. The sword motor is energized to move the extended sword rearwardly to engage any signatures that may bow excessively from the discharge end of the consolidating conveyor. The sword stops when it engages those signatures and ensures that they do not fall forward.

After the bundle 13 is moved fully into the compression unit, the clutch 48 is disengaged so that the side belts 40 of the accumulating conveyor 19 revert back to their normal operating speed, which is slightly less than the speed of the belts 26 and 30 for the consolidating conveyor. The air cylinders 76 retract the wings 72, thereby releasing the signatures at the discharge end of the conveyor so that their side edges can move into engagement with the side belts 40 of the accumulating conveyor. The sword remains extended, and the sword motor is energized by the proximity switch to cause the sword to move forward at approximately the same speed as the signatures. The tension spring on the sword provides adequate back pressure on the forward end of the signatures behind the sword to keep those signatures in an upright condition.

As the compression fingers move forward past the point where the drop board assembly places boards in the path 12, the drop board assembly is energized to drive an end board down into the signature path behind the extended compression fingers at the rear end of the bundle. Air cylinder 107 is actuated to retract the compression fingers 106, and the compression motor is energized to turn the threaded shaft so that the retracted compression fingers move slightly to the rear of the end board. The compression fingers are then extended back into the path 12 behind the end board at the rear end of the bundle. The compression motor is then actuated to turn the threaded shaft so the compression fingers move forward again, forcing the rear end board against the rear end of the bundle and driving the bundle against stop 160, forcing the bundle into a compact unit, which is then secured in that condition by the strap 15 from the strapping machine (FIGS. 7*h* and 7*i*). The compression fingers are then moved slightly to the rear, retracted, and returned to their home position to be ready for insertion into the next gap to be formed. At the same time, the cylinder 162 moves the stop to the rear and then forward. This pushes the bundle a slight distance away from the stop 160 and positions the bundle for removal to the supporting rollers 170. Thereafter, the pusher unit 164 is energized, and it moves the roller 166 laterally across the signature path so the roller 166 bears against the side of the bundle and drives it laterally, causing it to slide across the roller-type slide bars 128, which revolve to accommodate the movement. The bundle then moves onto the supporting rollers 170.

As the compression fingers compress the bundle and hold it during the strapping operation, more signatures accumulate on the accumulating conveyor 19 so that enough signatures accumulate to form another bundle, at which time another separation is effected at the transition between the consolidating and accumulating conveyors. The foregoing cycle is then repeated, producing another tight bundle of signatures.

With the apparatus of this invention, the sword not only forms a distinct gap at the rear end of each bundle of signatures, but it thereafter supports the signatures which form the forward end of the next bundle until that next bundle reaches an end board. Moreover, the compression fingers used to move the loose bundle from the accumulating conveyor to the compression unit also serve to apply the final compression force to the bundle during the strapping operation. Thus, the present invention results in simpler construction of the machine and provides better control of the signatures for the bundle-forming operation.

I claim:

1. A machine for handling a succession of flexible sheets, such as signatures, to obtain discrete bundles of the signatures from the succession, the machine comprising:

first and second conveyors aligned to define a path along which the signatures are advanced, each of the conveyors being configured to support the signatures in an edge-standing condition with the signatures bowed convex forwardly in the direction of advance so the midportion of each sheet leads the side edges for that sheet, each of the conveyors having moving surfaces against which the signatures are positioned such that the signatures move with the moving surfaces, the moving surfaces of the second conveyor being along the sides of that conveyor;

the second conveyor being located immediately after the first conveyor so the signatures pass from the moving surfaces of the first conveyor to the moving surfaces of the second conveyor;

drive means for advancing the moving surfaces of the first and second conveyors, with the surfaces of the first conveyor normally moving at a velocity no less than the surfaces of the second conveyor;

means for momentarily increasing the speed of the surfaces of the second conveyor to a velocity greater than the velocity of the surfaces of the first conveyor to produce a region of looseness in the succession of signatures;

a sword located in a home position adjacent the path where the region of looseness develops and normally being retracted from the path;

means for extending the sword into the path so it passes between two adjacent signatures in the region of looseness;

means for thereafter moving the sword forward to create a distinct gap in the succession of signatures so as to isolate a bundle of signatures ahead of the gap;

compression fingers located adjacent the path in the vicinity of where the region of looseness develops;

means for extending the compression fingers into the gap behind the isolated bundle of signatures;

means for moving the extended compression fingers along the path and away from the first conveyor so as to move the isolated bundle of signatures off the second conveyor;

means for causing the extending sword to contact and support the forward end of the succession of signatures to the rear of the gap;

means for moving the sword in front of the succeeding signatures toward a support in the path;

means for retracting the sword from the path so the forward end of the following signatures bear against the support; and means for returning the sword to its home position.

2. Apparatus according to claim 1 which includes sensor means for detecting when the sword engages the forward end of the succession of signatures to the rear of the gap, and means responsive to the sensor for controlling the movement of the sword along the path.

3. Apparatus according to claim 1 in which the sword is mounted to pivot relative to the machine in response to contact by signatures, sensor means for detecting the pivoting of the sword, and means responsive to the sensor means for controlling the movement of the sword along the path.

4. Apparatus according to claim 1 in which the sword is mounted on a reversible belt, and means are provided for driving the belt forwardly and rearwardly along the path.

5. Apparatus according to claim 1 which includes a ball-screw conveyor for driving the compression fingers back and forth along the path.

* * * * *

UNITED STATES PATENT AND TRADEMARK OFFICE

CERTIFICATE OF CORRECTION

PATENT NO. : 4,824,093

DATED : April 25, 1989

INVENTOR(S) : WILLIAM P. BELDEN

It is certified that error appears in the above-identified patent and that said Letters Patent is hereby corrected as shown below:

Abstract, line 8,"consildating" should read -- consolidating --
line 13,"increasd" should read -- increased --
line 15, "signatues" should read -- signatures"
Col. 8, line 43, "when" should read -- When --
Col. 10, lines 45-46, Cancèl "The stop 160 is the end of the signature path 12.", second occurrence

Signed and Sealed this

Eighth Day of May, 1990

*Attest:*

*Attesting Officer*

HARRY F. MANBECK, JR.

*Commissioner of Patents and Trademarks*